United States Patent [19]

Eaton

[11] Patent Number: 4,511,203

[45] Date of Patent: Apr. 16, 1985

[54] DEVICE FOR PROVIDING ATTACHMENT TO SPACED PARALLEL CABLES OR RODS

[75] Inventor: Richard H. Eaton, Lynchburg, Va.

[73] Assignee: General Electric Company, King of Prussia, Pa.

[21] Appl. No.: 172,183

[22] Filed: Jul. 25, 1980

[51] Int. Cl.[3] ..... H01R 11/10

[52] U.S. Cl. ..... 339/255 P; 339/264 R

[58] Field of Search ..... 339/255 R, 95 R, 253 L, 339/255 P, 263 L, 264 R, 264 L, 266 R, 266 G, 266 L, 231, 235, 238, 274, 255 B, 254; 24/120, 132 R, 132 WL, 134 L, 134 N

[56] References Cited

U.S. PATENT DOCUMENTS

| | | | |
|---|---|---|---|
| 2,849,777 | 9/1958 | Ridgers et al. | 339/263 L X |
| 2,858,516 | 10/1958 | Lindahl et al. | 339/263 L X |
| 2,986,053 | 5/1961 | Atman et al. | 339/264 R X |
| 3,132,914 | 5/1964 | Wengen | 339/264 L X |
| 3,248,684 | 4/1966 | Hubbard et al. | 339/266 R X |
| 3,425,028 | 1/1969 | Neaderland | 339/266 R X |
| 3,622,689 | 11/1971 | Sparks | 24/132 R X |
| 3,963,855 | 6/1976 | Hawkins et al. | 24/132 R X |
| 4,179,774 | 12/1979 | Bradbury | 24/132 R |

*Primary Examiner*—Joseph H. McGlynn

*Attorney, Agent, or Firm*—William Freedman; James J. Williams

[57] ABSTRACT

An attaching device is provided for parallel and spaced cable turns. The device includes an insulating yoke formed from a plate whose thickness is less than the spacing between the cable turns. The yoke is provided with semicircular recesses which fit partially around adjacent turns. A metallic clamp is attached to the yoke and is provided with a recess which opposes one of the yoke recesses to engage only one turn between the clamp recess and the one yoke recess. The device is securely attached but does not short circuit turns, and can be easily and rapidly relocated.

15 Claims, 4 Drawing Figures

DEVICE FOR PROVIDING ATTACHMENT TO SPACED PARALLEL CABLES OR RODS

BACKGROUND OF THE INVENTION

My invention relates to an attaching device, and particularly to an attaching device for providing a mechanical attachment or an electrical connection to spaced parallel cables or rods.

In many applications, particularly carrier systems used on electrical power transmission lines, a parallel resonant circuit of a capacitor or an inductor or line trap is used to pass the power frequency but to block the higher carrier frequencies. Because the carrier frequencies may not be determined until after the line trap has been constructed and installed, it is desirable or necessary that the resonant frequency of the parallel circuit be adjustable. Typically this is accomplished by connecting the capacitor between one end of the inductor and a selected location on the inductor turns.

Accordingly, a general object of my invention is to provide a new and improved device for adjusting the resonant frequency of a parallel circuit including a line trap.

Another object of my invention is to provide a new and improved device that can be easily attached at any desired location on one of a plurality of turns of an inductor or line trap.

Devices for providing attachment to line traps are known. However, such known devices have some disadvantages. For example, some of the devices are relatively difficult to attach to the wire or cable forming the line trap, and require that a worker use both hands in order to position and securely fasten the device. Some of the devices can be improperly installed and make contact with more than one turn of the inductor windings forming the line trap, thus short circuiting turns and making adjustment difficult or inaccurate, or even causing some damage to the line trap. Some of the devices tend to work loose and rotate on the round cable used on many line traps, thereby short circuiting turns.

Accordingly, another object of my invention is to provide a new and improved device that provides attachment to a line trap and that eliminates many of the problems and disadvantages of prior art devices.

Another object of my invention is to provide a new and improved device that is relatively easy to position on a line trap, to adjust, and then to tighten at a desired and relatively precise location on the line trap.

Another object of my invention is to provide a new and improved device that can be electrically connected to only one turn of an inductor or line trap at the desired location.

Another object of my invention is to provide a new and improved device that can be securely attached to a line trap, but that can be easily loosened and relocated for adjustment of the line trap.

SUMMARY OF THE INVENTION

Briefly, these and other objects are achieved in accordance with my invention by an attaching device having a yoke formed of a plate of relatively strong insulating material. The thickness of the yoke is less than the spacing between adjacent turns of the line trap. Concave recesses are provided in opposite edges of the yoke for fitting partially around adjacent turns when the yoke is inserted between adjacent turns. A clamp formed of a metallic plate is attached to the yoke. The clamp also has a concave recess in one of its edges near one of the yoke recesses. When the clamp is tightened, its recess fits partially around the one desired turn in opposed relation to the one yoke recess so as to securely fasten the attaching device to only the one turn at the desired location. An electrical lead or mechanical connection may be fastened to the attaching device for any desired function. The attaching device thus provides an easily positioned attachment that is easily relocated and that does not short circuit turns.

BRIEF DESCRIPTION OF THE DRAWING

The subject matter which I regard as my invention is particularly pointed out and distinctly claimed in the claims. The structure and operation of my invention, together with further objects and advantages, may be better understood from the following description given in connection with the accompanying drawing, in which:

DESCRIPTION OF THE PREFERRED EMBODIMENT

Figure 1:
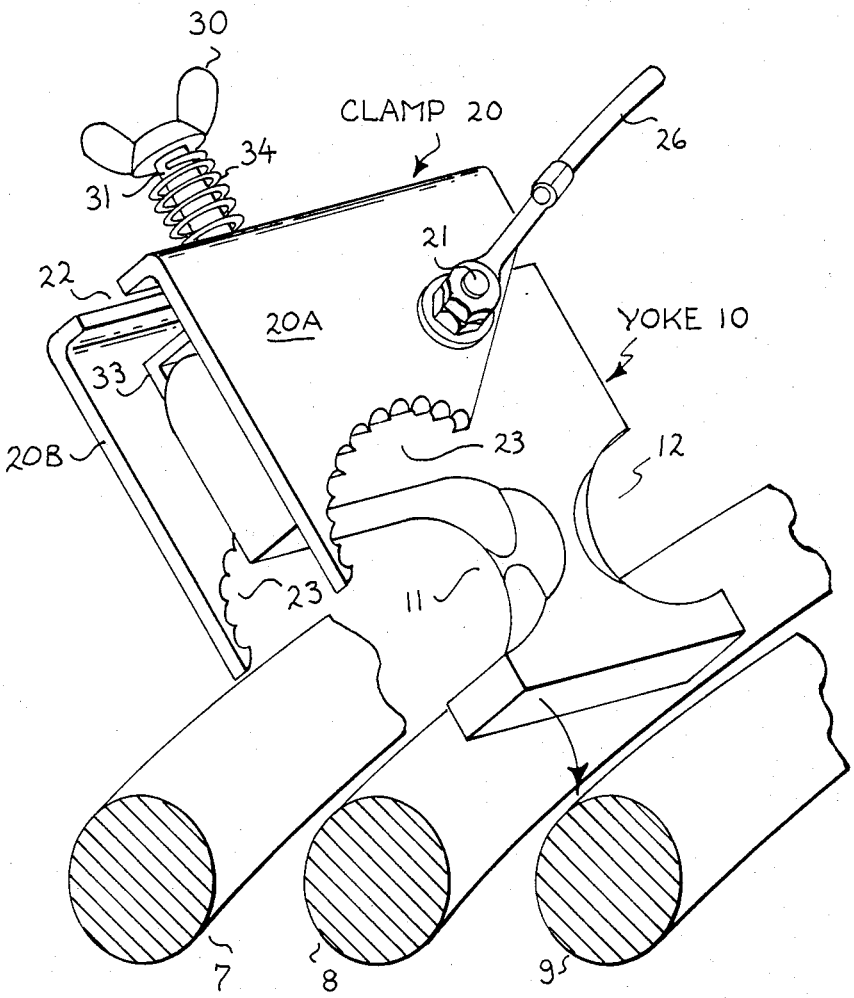
FIG. 1 shows a perspective view of my attaching device and several adjacent turns of an inductor or line trap.

In this description, I will first describe the construction of my attaching device, and then describe how my attaching device is positioned and attached. While I show my attaching device used with parallel turns of a line trap or inductor, persons skilled in the art will appreciate that my device can be used with almost any type of parallel wire, cable, or rods either to provide an electrical connection, or a mechanical connection. As shown in the four figures, my attaching device comprises a yoke 10 formed from a plate of suitable and relatively strong insulating material such as a phenolic or a glass-filled polyester. The thickness of the plate forming the yoke 10 is less than the space between the two adjacent turns 8, 9 of circular, stranded cable forming a line trap or inductor. The yoke 10 includes two opposed concave notches or recesses 11, 12, which are generally semicircular in shape and dimensioned to partially fit around the circular turns 8, 9 of the cable. The recesses 11, 12 are separated from each other by the spacing between two adjacent turns 8, 9. The semicircular edges forming the recesses 11, 12 may be rounded or chamferred if desired so as to provide easier twisting after insertion.

A clamp 20 is pivotally attached to the yoke 10 for securing my device to the turns 8, 9 of the line trap. The clamp 20 is formed from a suitable conductive material, such as aluminum, and is pivoted about a suitable pin or machine screw 21 to facilitate attachment. This pin or screw 21 may also serve as a point for attaching a lead, or wire 26, or other mechanical device. When used with a line trap, the wire 26 provides an appropriate electrical connection through the clamp 20 to the desired location on the turn 8. This wire 26 can be used to connect a capacitor to the turn 8, or to bypass turns of the line trap, or used as a tap to derive a suitable voltage. I prefer that the clamp 20 be U-shaped with two legs 20A, 20B and a cross member 20C which fit around the yoke 10. The legs or arms 20A, 20B are similar, and each is provided with a concave recess 23 forming part (135 degrees) of a circle to fit around a portion of the turn 8. These recesses 23 are preferably provided with serrations or teeth to provide good gripping and electrical contact, and are located so as to engage the turn 8 and force it against the edge of the recess 11.

To facilitate positioning and attachment of my device, I prefer that the clamp 20 be held by a wing nut 30 which is threaded on a machine screw 31. The machine screw 31 terminates in a U-shaped member 33 that pivots about a pin 32 which passes through an extension of the yoke 10 near the recess 11. The member 33 straddles the yoke extension and fits inside the legs 20A, 20B of the clamp 20. To permit the clamp 20 to be freely pivoted when my attaching device is mounted, I provide a slot 22 in the cross member 20C of the clamp 20 to permit the machine screw 31 to move about its pivot pin 32. The machine screw 31 may be provided with a compression spring 34 and washer 35 to prevent the wing nut 30 from rotating once it is tightened in final position, and to maintain a tightening force even if the wing nut 30 becomes loosened.

Figure 2:
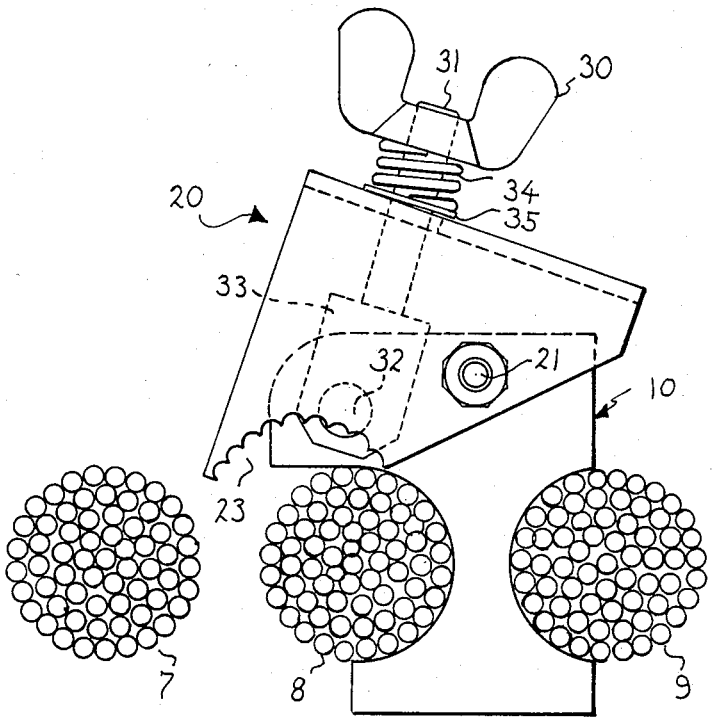
FIG. 2 shows a side view of my attaching device in the open and adjusting position after being inserted between two adjacent turns of an inductor or line trap.
Figure 3:
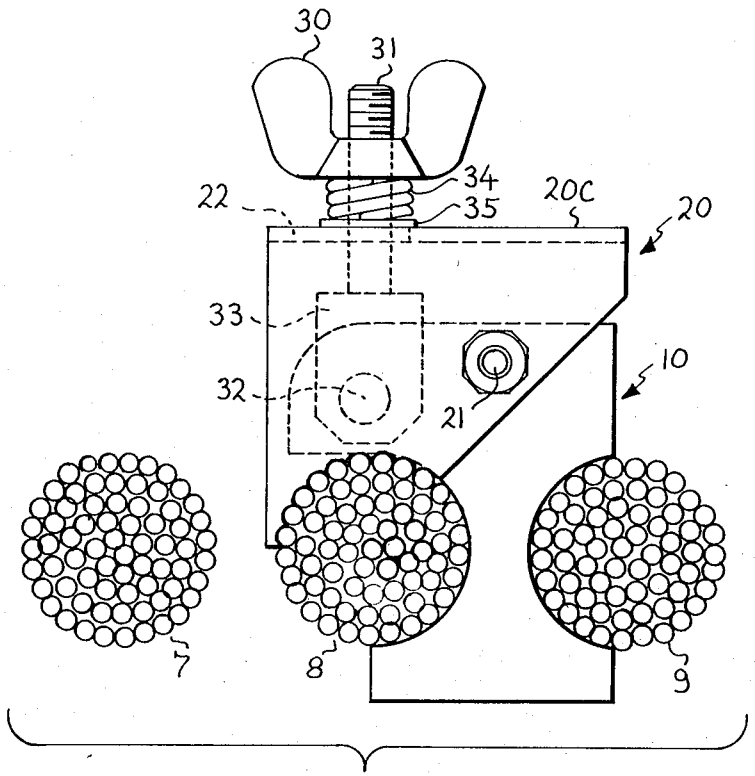
FIG. 3 shows a side view of my attaching device in the closed or clamped position between two adjacent turns of an inductor or line trap.
Figure 4:
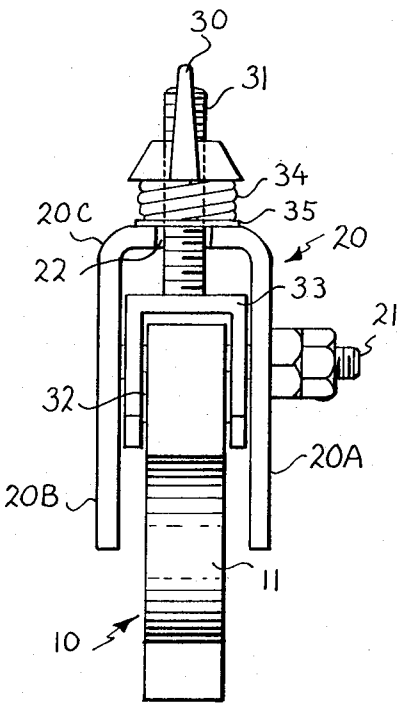
FIG. 4 shows an end view of my attaching device in the closed or clamped position.

When my attaching device is to be mounted, it is placed as shown in FIG. 1 so that the thickness dimension of the yoke 10 can pass between the spacing of the two desired adjacent turns 8, 9 of an inductor or line trap. After the yoke 10 is inserted so that the recesses 11, 12 are generally adjacent the turns 8, 9 the yoke 10 may be rotated approximately 90 degrees so that the edges or surfaces of the recesses 11, 12 partially surround and engage the respective turns 8, 9. The yoke 10 and the turns 8, 9 then have the relationship shown in the view of FIG. 2. With the clamp 20 held away from the turn 8, the device may be moved along the turns 8, 9 to the desired location. The clamp 20 is then pivoted about its pin 21 in a counterclockwise direction (as viewed in FIG. 2) and in a plane parallel to the yoke surface so that the teeth or edges of the recesses 23 engage the outer surface of the turn 8. With the attaching device so positioned, the wing nut 30 may then be tightened against its compression spring 34 to force the teeth around the recesses 23 against the turn 8 which is forced against the edge of the recess 11 of the yoke 10. This action provides firm engagement (and good ohmic contact) between the clamp 20 and the turn 8. The parts then have the relation as shown in FIGS. 3 and 4. The attaching device makes ohmic contact only with the desired turn 8, since the yoke 10 is made of insulating material, and since the clamp 20 is spaced from the next adjacent turn 7. The device also provides a strong mechanical attachment, since the turn 8 is compressed between the yoke 10 and the clamp 20.

It will thus be seen that I have provided a new and improved attaching device for use on parallel wires, cables, or rods to provide either an electrical connection (as contemplated) or a mechanical attachment. My device can be easily installed and clamped at any desired position between two adjacent turns or rods, and can be securely tightened, all with the use of one hand. This feature is particularly helpful to a workman who must work in inaccessible and precarious locations, such as an installed line trap on an existing electrical power transmission system. Also, it will be seen that my attaching device provides connection only to one turn, and can not short circuit or in any way affect any other turns.

While I have shown only one embodiment of my invention, persons skilled in the art will appreciate the many modifications that may be made to my invention. For example, in addition to the recesses being circular, they may be shaped to fit other cross sections of cables or rods, such as square. Also, while I prefer that the recesses 11, 12 on the yoke 10 be approximately a semicircle (i.e. 180 degrees), the recesses 11, 12 may have less circumferential length, for example, 120 degrees. Similarly, the recesses 23 on the clamp 20 may have other circumferential lengths than the 135 degrees shown. And while I primarily contemplate that my invention be used to provide electrical connections, it may also provide mechanical attachment. In such a case, the yoke may be made of metal rather than insulating material. I also prefer that the clamp 20 be U-shaped so that its two legs 20A, 20B straddle the yoke 10. However, this is not necessary, and the clamp 20 may be L-shaped so as to have only one leg which pivots on only one side of the yoke 10, and a cross member for the clamping nut. And finally, I prefer that the clamp 20 pivot and the machine screw 31 pivot to facilitate installation. The pivoting arrangement described and shown insures that my attaching device is self-connected, a feature which makes installation and adjustment easier. However, other configurations may be possible. Therefore, while my invention has been described with reference to a particular embodiment, it is to be understood that modifications may be made without departing from the spirit of the invention or from the scope of the claims.

What I claim as new and desire to secure by Letters Patent of the United States is:

1. An improved attaching device for a line trap or device having a plurality of spaced turns or members, said attaching device comprising:

a. an insulating yoke formed of a plate of insulating material having a thickness sufficiently small to be inserted in the space between two adjacent turns or members of a line trap or device, said yoke having a first concave notch bounded by an edge shaped to fit in engagement with a portion of a first of said turns or members, and having a second concave notch bounded by an edge shaped to fit in engagement with a portion of a second of said turns or members adjacent said first turn or member, said notches being opposed and separated by a distance substantially equal to said space between said two adjacent turns or members;

b. a metallic clamp formed of a plate of conductive material mounted on said yoke for pivoting in a plane generally parallel to said yoke plate, said clamp having a concave notch that is bounded by an edge shaped to fit in engagement with a portion of said first turn or member;

c. and clamping means attached to said yoke for urging said metallic clamp to pivot in said plane and in a direction to cause said edge of said clamp notch toward said edge of said first yoke notch.

2. The improved attaching device of claim 1 wherein said yoke notches are bounded by a circular edge of substantially 180 degrees.

3. The improved device of claim 1 or claim 2 wherein said clamping means comprise a threaded member pivotally mounted on said yoke for pivoting in a plane generally parallel to said yoke plate.

4. The improved device of claim 1 or claim 2 wherein said clamp notch is bounded by a circular edge of substantially 135 degrees.

5. The improved device of claim 4 wherein said clamping means comprise a threaded member pivotally mounted on said yoke for pivoting in a plane generally parallel to said yoke plate.

6. The improved device of claim 4 wherein said clamp is formed of a substantially U-shaped plate having legs positioned on opposing surfaces of said yoke, and wherein each of said legs has a concave notch, each of which is bounded by an edge shaped to fit in engagement with a portion of said first turn or member.

7. The improved device of claim 6 wherein said clamping means comprise a threaded member pivotally mounted on said yoke for pivoting in a plane generally parallel to said yoke plate.

8. The improved device of claim 1 or claim 2 wherein said clamp is formed of a substantially U-shaped plate having legs positioned on opposing surfaces of said yoke, and wherein each of said legs has a concave notch, each of which is bounded by an edge shaped to fit in engagement with a portion of said first turn or member.

9. The improved device of claim 8 wherein said clamping means comprise a threaded member pivotally mounted on said yoke for pivoting in a plane generally parallel to said yoke plate.

10. An improved device for providing an electrical connection to a selected location on one of a plurality of substantially parallel spaced turns forming the winding of an inductor comprising:

a. a yoke comprising a plate of insulating material having a recess on each of two opposite edges thereof, said plate having a thickness less than the spacing between an adjacent pair of winding turns, and said recesses accommodating a portion of said adjacent pair of turns respectively;

b. a clamp comprising a metallic plate having a recess on one of said edges, said recess accommodating a portion of one of said turns;

c. and means for attaching said clamp to said yoke with said clamp recess in at least a partially opposed relation to one of said yoke recesses for holding one of said turns in said opposed recesses, thereby attaching said device to said one turn.

11. The improved device of claim 10 wherein said means for attaching said clamp to said yoke includes a pivot pin that permits said clamp to pivot.

12. The improved device claim 10 or claim 11 wherein said clamp comprises a U-shaped plate, the legs of said U straddling said yoke, and each of said legs having a respective recess therein.

13. An improved device for providing a mechanical attachment to a selected location on one of a plurality of substantially parallel spaced rods comprising:

a. a yoke comprising a plate having a recess on each of two opposite edges thereof, said plate having a thickness less than the spacing between an adjacent pair of said rods, and said recesses accommodating a portion of said adjacent pair of said rods respectively;

b. a clamp comprising a plate having a recess on one of said edges, said recess accommodating a portion of one of said rods;

c. and means for attaching said clamp to said yoke with said clamp recess in at least a partially opposed relation to one of said yoke recesses for holding one of said rods in said opposed recesses, thereby attaching said device to said one rod.

14. The improved device of claim 13 wherein said clamp is pivotally attached to said yoke.

15. The improved device of claim 13 or claim 14 wherein said clamp is U-shaped, and wherein the legs of the U straddle said yoke, and wherein each of said legs includes a respective one of said recesses.

* * * * *